US012011806B2

(12) United States Patent
Baer et al.

(10) Patent No.: US 12,011,806 B2
(45) Date of Patent: Jun. 18, 2024

(54) IMPELLER FOR A BLAST WHEEL MACHINE

(71) Applicant: WHEELABRATOR GROUP LIMITED, Cheshire (GB)

(72) Inventors: Christoph Baer, Bassersdorf (CH); Philipp Weissenberger, Klettgau (DE); Stanislav Venclik, Opfikon (CH)

(73) Assignee: Wheelabrator Group Limited, Cheshire (GB)

( * ) Notice: Subject to any disclaimer, the term of this patent is extended or adjusted under 35 U.S.C. 154(b) by 370 days.

(21) Appl. No.: 17/621,020

(22) PCT Filed: Apr. 23, 2020

(86) PCT No.: PCT/EP2020/061389

§ 371 (c)(1),
(2) Date: Dec. 20, 2021

(87) PCT Pub. No.: WO2020/259893

PCT Pub. Date: Dec. 30, 2020

(65) Prior Publication Data

US 2022/0331934 A1 Oct. 20, 2022

Related U.S. Application Data

(60) Provisional application No. 62/865,434, filed on Jun. 24, 2019.

(51) Int. Cl.

| | |
|---|---|
| ***B24C 5/06*** | (2006.01) |
| ***B24C 3/24*** | (2006.01) |
| ***B24C 3/30*** | (2006.01) |

(52) U.S. Cl.

CPC ..... *B24C 5/062* (2013.01); *B24C 5/068* (2013.01)

(58) Field of Classification Search

CPC ..... B24C 5/06; B24C 5/062; B24C 5/064; B24C 5/066; B24C 5/068; B24C 3/14; B24C 3/24; B24C 3/30

(Continued)

(56) References Cited

U.S. PATENT DOCUMENTS 4,333,278 A * 6/1982 Schulte ..... B24C 5/06 451/97
4,395,851 A * 8/1983 Watts ..... B24C 5/06 D15/124

(Continued)

FOREIGN PATENT DOCUMENTS

JP 5580164 B2 8/2014
WO 2016013527 A1 1/2016

(Continued)

OTHER PUBLICATIONS

Notification of Transmittal of the International Search Report and the Written Opinion of the International Searching Authority from corresponding PCT/EP2020/061389 dated Jul. 16, 2020.

*Primary Examiner* — Eileen P Morgan
(74) *Attorney, Agent, or Firm* — Lando & Anastasi, LLP

(57) ABSTRACT

An impeller for a centrifugal blast wheel machine includes a hub provided at one end of the impeller, with the hub being configured to be coupled to the motor. The impeller further includes a tapered section provided at an opposite end of the hub, with the tapered section defining a media inlet to receive blast media. The impeller further includes a plurality of drop-shaped vanes positioned between the hub and the tapered section. The plurality of drop-shaped vanes is spaced from one another on peripheries of the hub and the tapered section. The plurality of drop-shaped vanes defines a plurality of impeller media outlets constructed and arranged to allow egress of blast media upon rotation of the impeller. Each vane is drop-shaped having a leading side directed (Continued)

toward a direction of rotation of the impeller and a trailing side opposite the leading side.

20 Claims, 6 Drawing Sheets

(58) Field of Classification Search
USPC ..... 451/38, 95, 98
See application file for complete search history.

(56) References Cited

U.S. PATENT DOCUMENTS

| | | | | | |
|---|---|---|---|---|---|
| 4,480,413 | A * | 11/1984 | Schulte | B24C 5/06 | 451/98 |
| 4,751,798 | A * | 6/1988 | McDade | B24C 5/06 | 416/220 A |
| 2009/0137193 | A1* | 5/2009 | Iwata | B24C 5/06 | 451/96 |
| 2016/0354897 | A1* | 12/2016 | Kaga | B24C 3/30 | |
| 2021/0078137 | A1* | 3/2021 | Liao | B24C 5/062 | |

FOREIGN PATENT DOCUMENTS

| | | | |
|---|---|---|---|
| WO | 2017014767 | A1 | 1/2017 |
| WO | 2017061989 | A1 | 4/2017 |

* cited by examiner

IMPELLER FOR A BLAST WHEEL MACHINE

CROSS-REFERENCE TO RELATED APPLICATION

This application is a U.S. National Stage Application under 35 U.S.C. § 371 of International Application No. PCT/EP2020/061389, filed Apr. 23, 2020, titled IMPELLER FOR A BLAST WHEEL MACHINE, which claims the benefit under 35 U.S.C. § 119(e) of U.S. Provisional Application No. 62/865,434, filed Jun. 24, 2019, titled IMPELLER FOR A BLAST WHEEL MACHINE, both of which are hereby incorporated by reference in their entirety for all purposes.

BACKGROUND OF THE DISCLOSURE

1. Field of the Disclosure

The present disclosure relates generally to abrasive blast wheels and methods for cleaning or treating surfaces of work pieces, and more particularly to an improved impeller designed to prevent abrasive from being crushed prior to being applied by a blast wheel and to improve a volume of abrasive being thrown at a treated surface by the blast wheel.

2. Discussion of Related Art

Centrifugal blast wheel machines generally include a rotatable wheel having a plate or a pair of spaced plates that carry radially extending blades. Particulate matter is discharged from a center of the blast wheel onto rotating surfaces of the blades, which propel the particulate matter against surfaces of a work piece to be cleaned or treated. Specifically, blast media is fed from a feed spout into a rotating impeller situated within a control cage at the center of the blast wheel. The media is fed from the impeller, though an opening in the control cage, and onto the heels or the inner ends of the rotating blades. The media travels along the faces of the blades and is thrown from the tips of the blades at the work piece surfaces to be treated.

From observation of the internal operation of blast wheels and through maintenance on the blast wheel, the internal control surfaces of the impeller and the control cage directly affect the shape of the flow onto the surface of the throwing blade, which can cause one edge of the blade to wear more than the other edge of the blade over time. The sharp edges of the conventional impeller vanes create shear points between the control cage opening and the impeller, which results in crushed abrasive media, and cause the media to congest within the impeller and not escape to the outer race of the control cage as easily.

Significant portion of the total cost of ownership of a shot blast machine is related to abrasive consumption. It is desirable to improve the overall blast wheel performance, mainly reducing the abrasive consumption while having the other blast wheel parameters (abrasive throughput, blast pattern, blast intensity) perform at the same or similar level.

SUMMARY OF THE DISCLOSURE

One aspect of the disclosure is directed to a centrifugal blast wheel machine comprising a wheel assembly having a plurality of blades configured to throw blast media introduced into the wheel assembly against a work piece. The centrifugal blast wheel machine further comprises an impeller positioned about an axis of the wheel assembly. The impeller has a media inlet at one end adapted to receive blast media and a plurality of impeller media outlets constructed and arranged to allow egress of blast media upon rotation of the impeller. The machine further includes a motor coupled directly to the impeller, or a motor, transmission and bearing unit with bearing unit shaft coupled to the impeller, to drive the rotation of the impeller and the wheel assembly and a control cage surrounding the impeller and secured to the wheel assembly. The control cage includes a cylindrical body defining an interior chamber. The cylindrical body has an opening formed therein to allow the egress of blast media from the interior chamber. The impeller includes a hub provided at one end of the impeller. The hub is configured to be coupled to the motor or bearing unit shaft. A tapered section is provided at an opposite end of the hub, with the tapered section defining a media inlet to receive blast media. A plurality of drop-shaped vanes is positioned between the hub and the tapered section, with the plurality of drop-shaped vanes being spaced from one another on peripheries of the hub and the tapered section. The plurality of drop-shaped vanes defines a plurality of impeller media outlets constructed and arranged to allow egress of blast media upon rotation of the impeller.

Embodiments of the machine further may include spacing the plurality of drop-shaped vanes equidistant from one another on peripheries of the hub and the tapered section. In one embodiment, each drop-shaped vane includes a sharp edge, a leading side in rotation direction of the blast wheel assembly, followed by the trailing side of the drop-shaped vane. Each drop-shaped vane may have an angle on the leading side between 50° and 70°, preferably an angle of the leading side between 55° and 65°. Each drop-shaped vane may have a radius of the trailing side between 3 mm and 8 mm, preferably a radius of the trailing side between 4 mm and 7 mm. Each vane of the plurality of drop-shaped vanes may be spaced apart from one another with a center-to-center distance dictated by the number of vanes. The plurality of drop-shaped vanes may be spaced from the control cage a predetermined distance. The predetermined distance may be at least 3 mm. The plurality of drop-shaped vanes may include eight vanes.

Another aspect of the disclosure is directed to an impeller for a centrifugal blast wheel machine. In one embodiment, the impeller comprises a hub provided at one end of the impeller, with the hub being configured to be coupled to the motor or to the bearing unit shaft. The impeller further includes a tapered section provided at an opposite end of the hub, with the tapered section defining a media inlet to receive blast media. The impeller further includes a plurality of drop-shaped vanes positioned between the hub and the tapered section. The plurality of drop-shaped vanes is spaced from one another on peripheries of the hub and the tapered section. The plurality of drop-shaped vanes defines a plurality of impeller media outlets constructed and arranged to allow egress of blast media upon rotation of the impeller.

Yet another embodiment of the disclosure is directed to a method of operating a centrifugal blast wheel machine. In one embodiment, the method comprises: feeding blast media from a feed spout into an impeller of the centrifugal blast wheel machine; accelerating the blast media by rotating the impeller giving rise to a centrifugal force that moves the blast media in radial direction, away from an axis of the impeller; moving the blast media in a generally circular direction into a space between the impeller and a control cage; metering an amount of blast media through an opening of the control cage onto blades of a blast wheel; and moving the blast media along lengths of the blades to accelerate and throw the blast media toward a work piece. The impeller includes a hub provided at one end of the impeller, with the hub being configured to be coupled to the motor or to the bearing unit shaft. The impeller further includes a tapered section provided at an opposite end of the hub, with the tapered section defining a media inlet to receive blast media. The impeller further includes a plurality of drop-shaped vanes positioned between the hub and the tapered section. The plurality of drop-shaped vanes is spaced from one another on peripheries of the hub and the tapered section, the plurality of drop-shaped vanes defining a plurality of impeller media outlets constructed and arranged to allow egress of blast media upon rotation of the impeller.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1A:
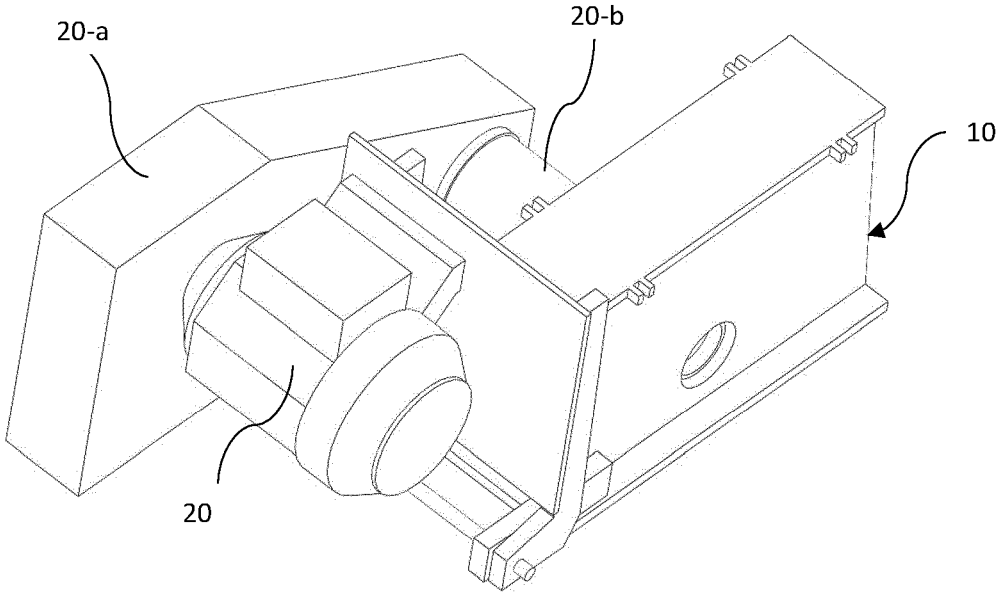
FIGS. 1A, 1B and 2 are a perspective views of a centrifugal blast wheel machine.

Centrifugal blast wheel machines generally include a rotatable wheel having a disc or a pair of spaced discs that carry radially extending blades. Particulate matter, sometimes referred to as the "abrasive", is discharged from a center of the blast wheel onto rotating surfaces of the blades, which propel the abrasive against surfaces of a work piece to be cleaned or treated.

Specifically, blast media is fed from a feed spout into a rotating impeller situated within a control cage at the center of the blast wheel. The media is fed through a feed pipe to the impeller, through an opening in the control cage, and onto the heels or the inner ends of the rotating blades. The media travels along the faces of the blades and is thrown from the tips of the blades at the work piece surfaces to be treated.

From observation of the internal operation of blast wheels and maintenance on the blast wheel, the control surfaces of the impeller, the control cage and the blades directly affect the amount of abrasive, the flow of the abrasive onto the surface of the throwing blade, the shape and size of the surface impacted by the abrasive (sometimes referred to as "blast pattern"), the impact of the abrasive on the surface of the work piece (sometimes referred to as "blast intensity"), the abrasive used and worn during the blasting process (sometimes referred to as "abrasive consumption"), which can cause the increase of total cost of ownership of the shot blast machine.

Different shapes of impeller vanes have different influence on these parameters and usually some parameters are improved but in the same time other parameters are worsen, so the overall performance of the blast wheel is not better.

One objective of embodiments of the present disclosure is find a shape of the impeller vanes which would result in less abrasive crushed inside of the blast wheel and therefore results in lower abrasive consumption respectively in lower costs for abrasive during the machine operation.

While using drop-shaped impeller vanes there is a lower abrasive consumption, up to 15%, against other conventional impeller vanes shapes. This means that the users of an impeller with such drop-shaped vanes in a blast wheel machine can save up to 15% costs for abrasive.

The blast wheel of embodiments of the present disclosure is designed to throw metallic shot, grit, cut wire, etc., which together may be referred to as "abrasive," "abrasive blast media," "abrasive media," "blast media," "media" or any suitable description of particulate matter. The blast wheel machine typically consists of four primary components that act in conjunction to throw the media at a target object to be cleaned, peened or otherwise have its surface prepared. An impeller acts to accelerate the abrasive media once the media is fed into a wheel assembly. The impeller rotates within the interior of a control cage, which may also be referred to as an "impeller case." The control cage acts to meter the abrasive blast media flow through an opening formed in the control cage to direct the flow of media onto rotating blades by adjusting the position of the opening. The control cage is stationary within the blast wheel under operating conditions. The blades (generally from two to twelve in number) rotate outside of the control cage and propel the abrasive blast media along their radial length toward the target. A bare wheel, which may also be referred to as a "runner head" or simply as a "wheel," holds the impeller and blades, and typically rotates the impeller and blades between 1500-3600 revolutions per minute (rpm) by way of a power source, which in one embodiment is an electric motor.

Embodiments of the present disclosure are directed to an improved impeller that is configured to reduce the abrasive consumption through a gentle handling of the abrasive inside the impeller and its smooth transition from impeller inner space through the opening in control cage to blades while keeping the other parameters as abrasive throughput, blast pattern and blast intensity on similar level as with conventional vane shapes.

Figure 1B:
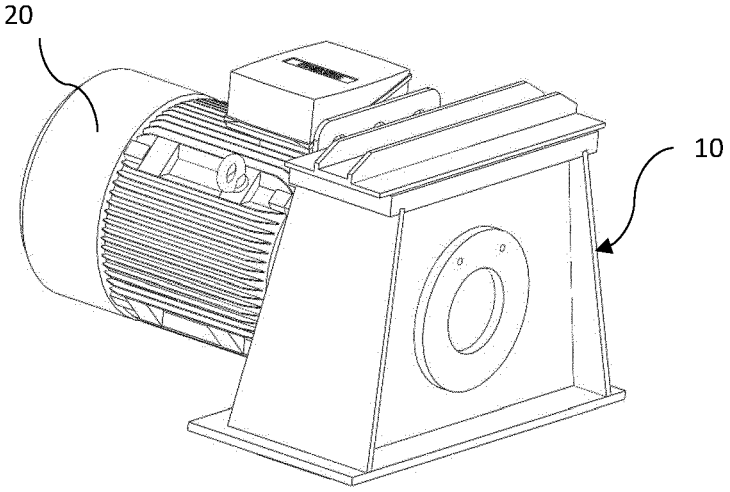
Figure 2:
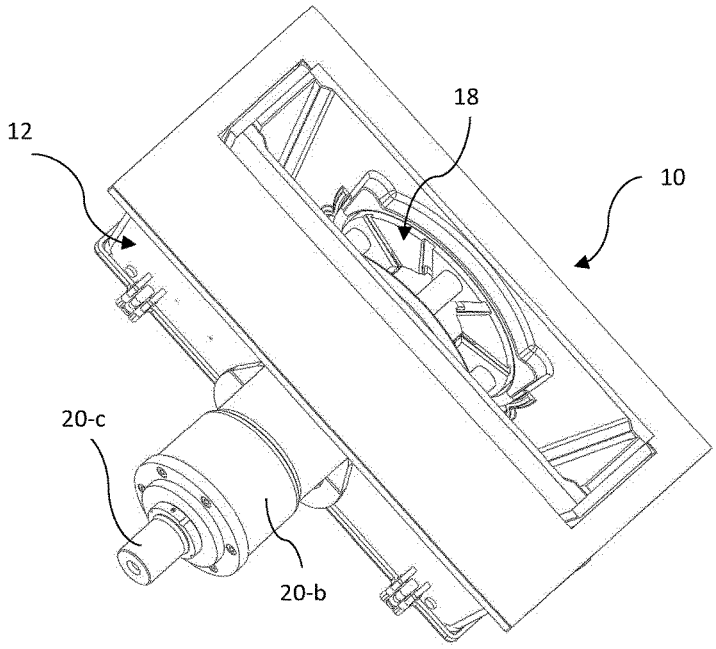
Figure 3:
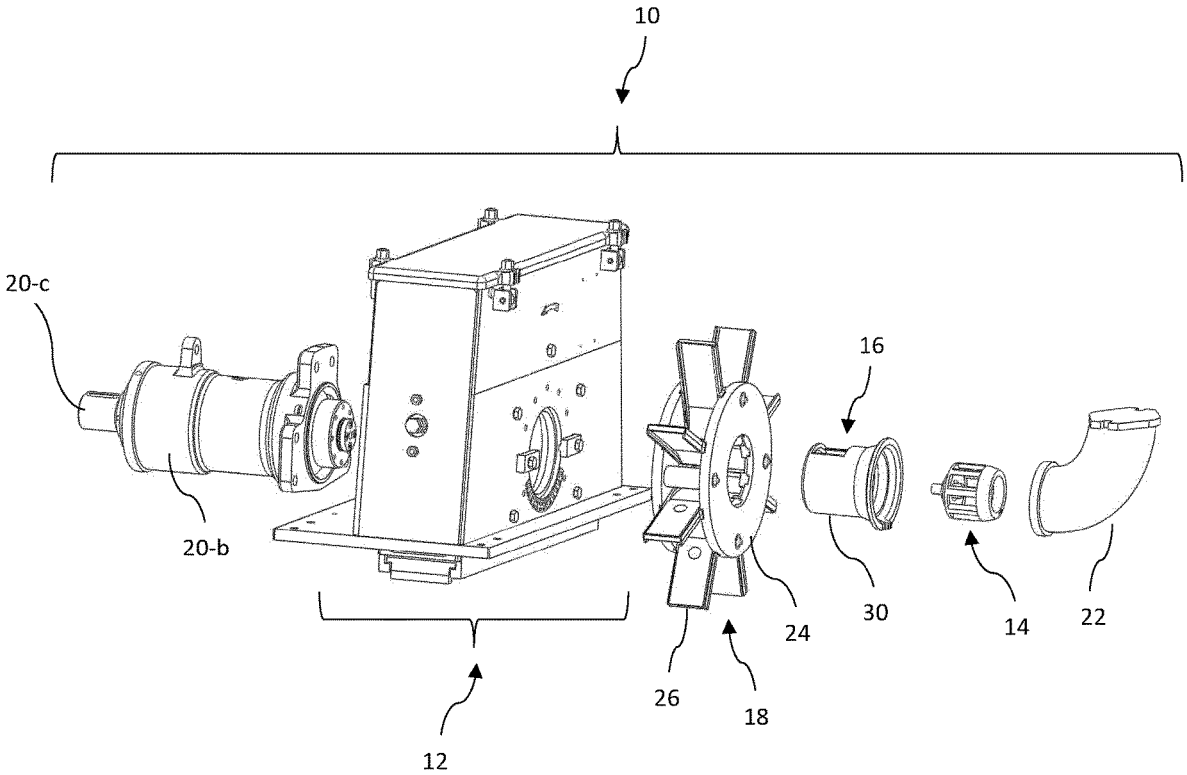
FIG. 3 is an exploded perspective view of the centrifugal blast wheel machine.

Referring to the drawings, and more particularly to FIGS. 1-3, a centrifugal blast wheel machine is generally indicated at 10. In one embodiment, the centrifugal blast wheel machine 10 includes a housing, generally indicated at 12, which is designed to house the components of the centrifugal blast wheel machine. The centrifugal blast wheel machine 10 further includes a rotating impeller, generally indicated at 14, supported by a drive shaft, a control cage assembly, generally indicated at 16, which surrounds the impeller, and a blast wheel assembly, generally indicated at 18, which receives the control cage assembly. A motor 20 is provided to drive the rotation of the impeller 14 and the blast wheel assembly 18. Another arrangement is a motor 20, transmission 20-*a*, bearing unit 20-*b* with bearing shaft 20-*c*. The arrangement is such that blast media is fed from a feed spout 22 into the rotating impeller 14, which is driven by the motor 20 directly or by the motor 20, transmission 20-*a*, bearing unit 20-*b* and bearing shaft 20-*c*. By contact with vanes of the rotating impeller 14 (as well as with other particles of media already in the impeller), blast media particles are accelerated, giving rise to a centrifugal force that moves the particles in radial direction, away from the axis of the impeller. The blast media particles, now moving in a generally circular direction as well as outwards, move through openings formed in the impeller 14 into a space between the impeller and a control cage 16, still being carried by the movement of the impeller vanes (also known as impellor dams) and the other particles.

When the blast media particles that have passed through the impeller openings into the space between the impeller 14 and the control cage 16 reach an opening provided in the control cage assembly, rotational and centrifugal forces move the particles through the opening. The control cage 16 functions to meter a consistent and appropriate amount of blast media onto the blades of the blast wheel assembly 18. As the vanes of the impeller 14 rotate, the blast media particles are moved along their lengths and accelerate until they reach the ends of the vanes and thrown from the ends of the vanes. Although the impeller 14 is shown to be cylindrical in shape, the size and thickness of the impeller may vary depending on the size of a blast wheel assembly and the desired performance characteristics. For example, the impeller 14 may have interior or exterior walls that taper in either direction along its axis. Typically, the impeller will be made of a ferrous material, such as cast or machined iron or steel, although other materials may also be appropriate. In one particular embodiment, the impeller is formed of cast white iron. The particular construction of the impeller 14 will be described in greater detail below.

The blast wheel assembly 18 of the centrifugal blast wheel machine 10 includes a hub or wheel 24 and a plurality of blades, each indicated at 26, to throw blast media introduced into the wheel assembly to treat the work piece contained within the housing 12. The arrangement is such that the impeller 14 is positioned about an axis of the wheel 24 of the blast wheel assembly 18, with the impeller having a media inlet at one end adapted to receive blast media and a plurality of impeller media outlets constructed and arranged to allow egress of blast media upon rotation of the impeller. The control cage 16 surrounds the impeller 14 in a position in which the media outlet of the control cage is adapted for passage of blast media to the heel ends of the blades of the blast wheel assembly 18. As mentioned above, the motor 20 is coupled to the impeller 14 and to the blast wheel assembly 18 by a drive shaft to drive the rotation of the impeller and the wheel assembly. In another embodiment the motor 20 is coupled with transmission 20-*a*, and a bearing unit 20-*b* with bearing unit shaft 20-*c* to drive the rotation of the impeller and the wheel assembly.

Figure 4:
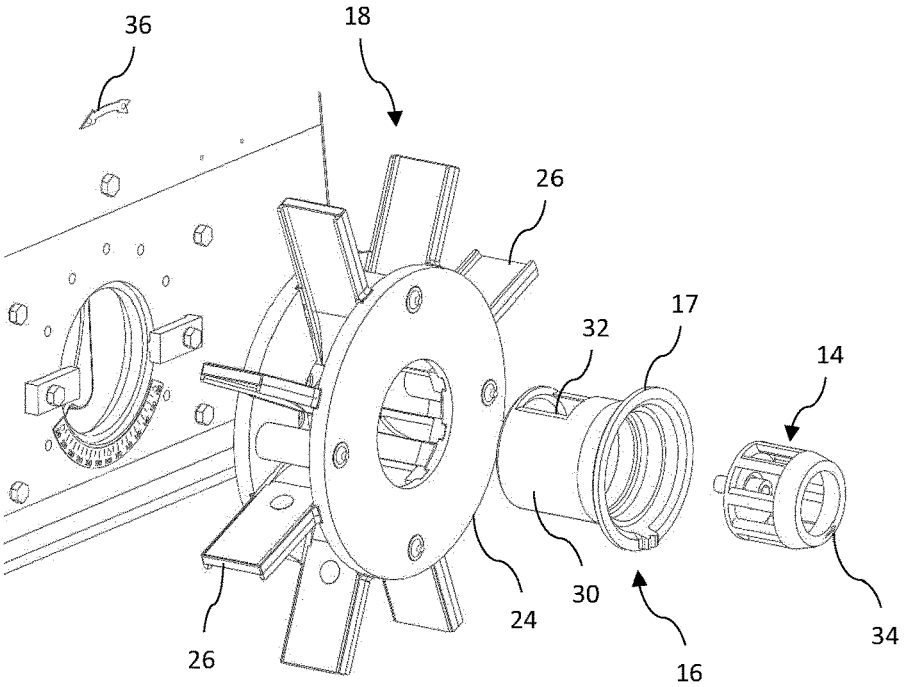
FIG. 4 is an exploded perspective view of a portion of a centrifugal blast wheel machine.

Referring to FIG. 4, in one embodiment, the control cage 16 having a cylindrical wall 30 forming a housing defining an interior chamber and a media outlet or opening 32 formed in the cylindrical wall for allowing the egress of blast media from the interior chamber. A typical centrifugal blast wheel machine 10 having the control cage 16 is used to treat a surface (not shown) of a work piece by projecting blast media (not shown) at the surface. The treatment may be in the nature of cleaning, peening, abrading, eroding, de-burring, de-flashing, and the like, and the blast media typically consists of solid particles such as shot, grit, segments of wire, sodium bicarbonate, or other abrasives, depending on the surface being treated and/or the material being removed from the surface.

The control cage 16, typically formed of cast iron (or similar material), is positioned concentrically around impeller 14 and, is approximately cylindrical in shape. Like the impeller 14, however, the control cage 16 may have other shapes, and may, for example, taper internally and/or externally in either direction along its axis. The control cage 16 also includes an outer flange 17, which in turn is attached to the housing 12 of the blast wheel assembly 18, fixing the control cage with respect to the wheel and preventing the control cage from rotating with respect to the wheel upon operation of the blast wheel assembly 10. The control cage 16 is then locked in place by placing the feed spout 22 onto the control cage and by firmly securing a feed spout bracket.

In other embodiments, the control cage 16 may be restrained from movement by attachment to other stationary elements of the blast wheel assembly 18 or its environment (as indicated above), or, in some cases, may be allowed to or made to rotate in one or both directions. As shown, the outer flange having markings or other indicia that allow a user to position the control cage 16 in a certain desired rotational orientation, so as to control the direction of the media being thrown by the blast wheel assembly 18.

As mentioned above, the media opening 32 of the control cage 16 allows egress of blast media upon operation of the blast wheel assembly 18. In the illustrated embodiment, the media opening 32 is approximately rectangular in shape when viewed from the side (i.e. in a direction perpendicular to its axis). The size, shape, and location of the media opening 32 may vary depending on the application, however. The length of the media opening 32 is measured in degrees, from the innermost portion of the opening furthest ahead in the direction of rotation to the outermost edge of the trailing portion. While the media opening 32 of the shown embodiment is approximately fifty-six degrees for a wheel rotating in either direction, in other embodiments, the length of the opening (in either direction) may vary, depending numerous factors such as the overall size of the blast wheel assembly 18, the nature of the media being thrown, and the desired rate of flow, as would be understood by one of skill in the art.

The blast wheel assembly 18, which is arranged concentrically around control cage 16, includes the plurality of blades 26 sandwiched between a rear wheel and a front wheel of the wheel 24 of the wheel assembly. The various parts of blast wheel assembly 18 are typically formed of cast iron, although they may also be made of any other appropriate material and/or method. The blast wheel assembly 18 is connected to the motor 20 or to the bearing unit shaft 20-*c*, in one embodiment by means of key inserted to lock a drive shaft to the rear wheel of the wheel assembly, so that wheel assembly may be rotated by motor during operation of the blast wheel assembly. In another embodiment, the blast wheel assembly 18 is connected to the motor 20 or to the bearing unit shaft 20-*c* by means of driving peg to lock a drive shaft to rear of the wheel assembly. Blades 26, each of which have a heel end and a tip, are constructed and arranged to direct the blast media at the surface being treated. The blades 26 may embody semi-curved blades, each blade having a curved portion positioned adjacent a central hub of the wheel assembly, and a straight portion integrally formed with the curved portion extending radially outwardly from the wheel assembly.

In other embodiment the blades may be of any suitable size and any suitable shape, including one or more of straight, curved, flared, flat, concave, or convex shapes.

The invention is primarily focused on blast wheel applications that throw metallic shot, grit, cut wire, etc. As discussed above, a blast wheel typically consists of four primary components that act in conjunction to throw the blast media at a target object to be cleaned, peened or otherwise have its surface prepared. These components are the impeller 14, the control cage 16, the blades 26, and the blast wheel 24.

The operation of the centrifugal blast wheel machine 10 is as follows. The blast media is fed from the feed spout 22 into the rotating impeller 14. By contact with the rotating impeller vanes (as well as with other particles of media already in the impeller 14), the blast media particles are accelerated, giving rise to a centrifugal force that moves the particles in radial direction, away from the axis of the impeller. The blast media particles, now moving in a generally circular direction as well as outwards, move through the impeller openings into the space between the impeller 14 and the control cage 16, still being carried by the movement of the impeller vanes and the other particles.

When the blast media particles that have passed through the impeller openings into the space between the impeller 14 and the control cage 16 to the media opening 32, the rotational and centrifugal forces move the particles through the media opening and onto the heel ends of the blades 26. The control cage 16 functions to meter a consistent and appropriate amount of blast media onto the blades 26. As the blades 26 of the blast wheel 24 rotate, the blast media particles are moved along their lengths and accelerate until they reach the tips, at which point they are thrown from the ends of the blades toward the work piece.

FIG. 4 illustrates the relationship of the impeller 14, the control cage 16 and the blast wheel assembly 18 prior to assembly. As shown, the impeller 14 fits within the body 30 of the control cage 16, which in turn fits within the blast wheel 24 of the blast wheel assembly 18. As will be shown in greater detail below, the impeller 14 includes drop-shaped vanes to reduce the abrasive consumption through a gentle handling of the abrasive inside the impeller and its smooth transition from impeller inside space through the opening in the control cage to blades. The drop-shaped vanes of the impeller 14 further keep the other blast wheel parameters as abrasive throughput, blast pattern and blast intensity same or similar to conventional vanes.

Figure 7:
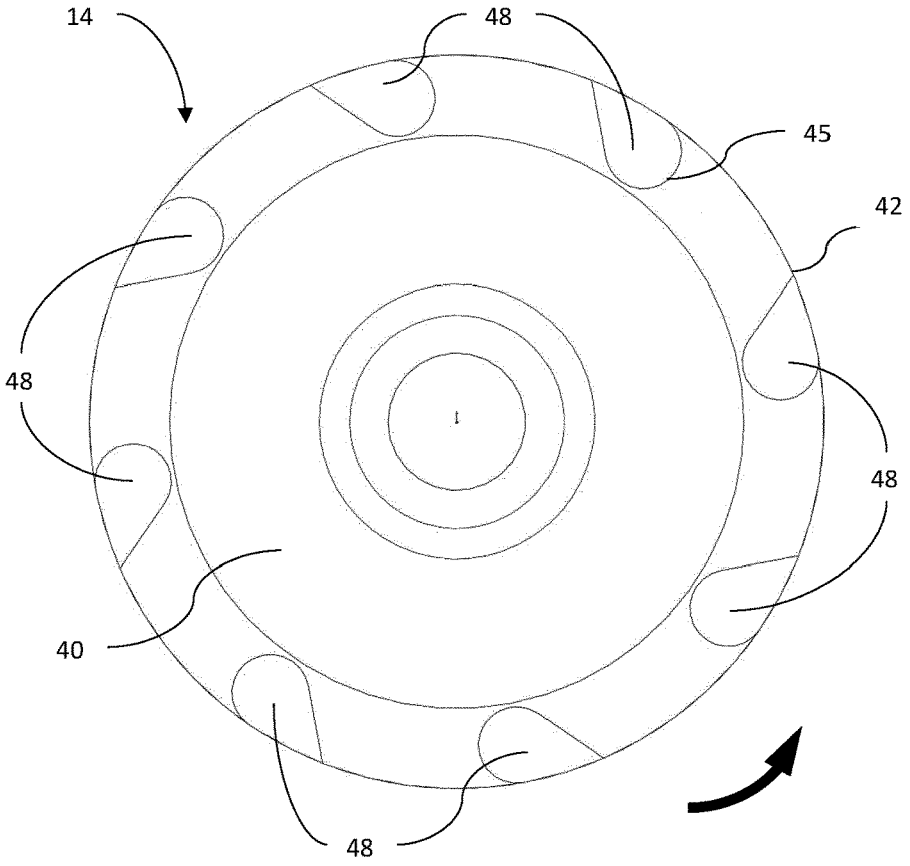
FIG. 7 is a cross-sectional view of the impeller.
Figure 8:
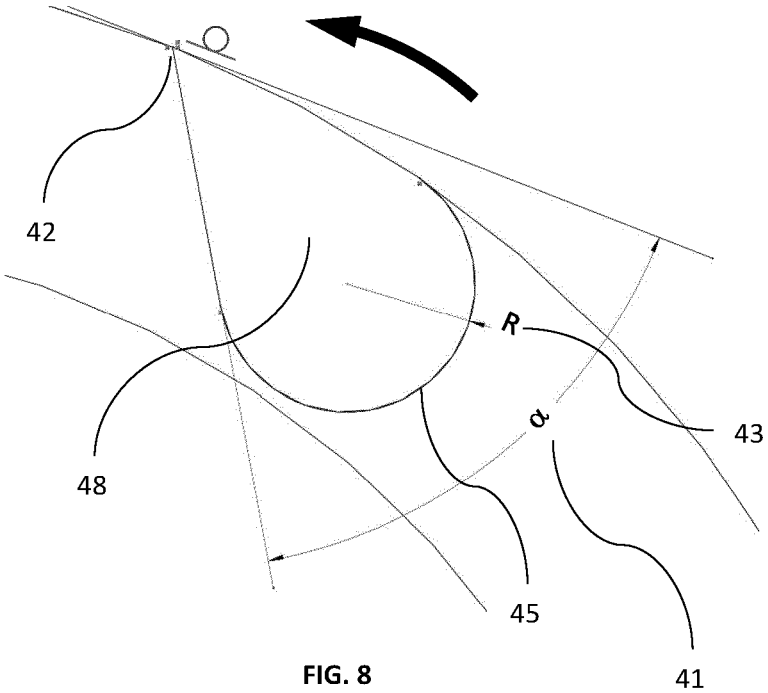
FIG. 8 is an enlarged cross-sectional view of a vane of the impeller.
Figure 9:
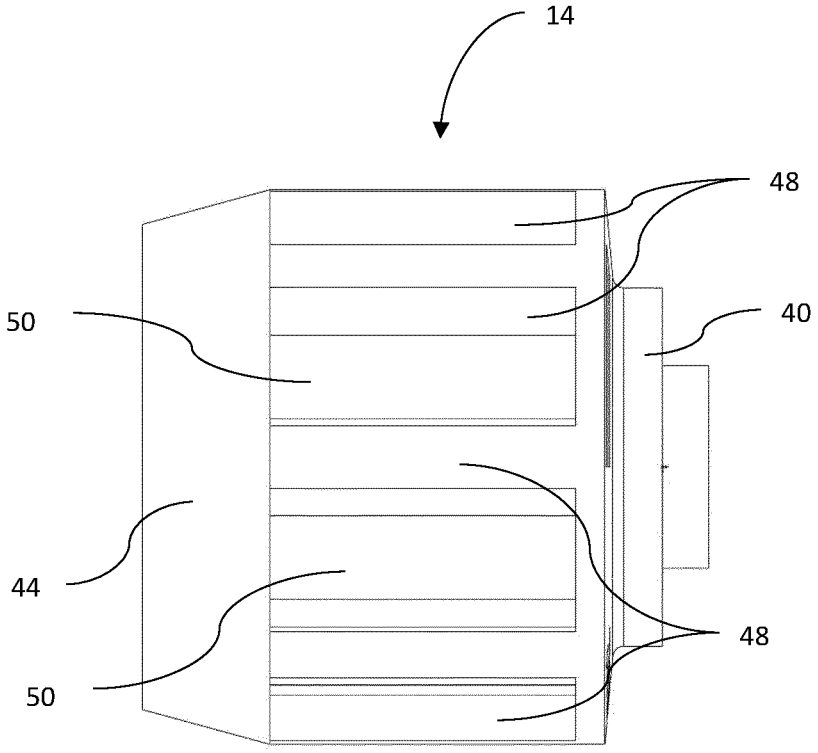
FIG. 9 is a side view of the impeller.

Referring to FIGS. 5-8 (whereas FIG. 7 is a sectional view of the impeller), an embodiment of the impeller 14 will be described. As shown, the impeller 14 includes a hub 40 provided at one end of the impeller. The hub 40 embodies a cylindrical body having a central opening formed therein that receives a drive shaft from the motor 20 or from bearing unit shaft 20-*c* and is coupled to the drive shaft by a key or some other suitable coupling. The impeller 14 further includes a tapered section 44 provided at an opposite end of the hub. The tapered section 44 defines a media inlet 46 to receive blast media from the feed spout 22. The impeller 14 further includes a plurality of drop shaped vanes, each indicated at 48, positioned between the hub 40 and the tapered section 44. As shown, the drop-shaped vanes 48 are spaced equidistant from one another on periphery of the impeller 14 defined by the hub 40 and the tapered section 44. The drop-shaped vanes 48 define a plurality of impeller media outlets, each indicated at 50, constructed and arranged to allow egress of blast media upon rotation of the impeller 14.

One of the surfaces of the impeller usually the front surface of the tapered section of the impeller may include arrow 34 or other sign indicating the rotating direction of the impeller with drop-shaped vanes. When impeller is assembled in the blast wheel assembly the arrow 34 has to show same direction as an arrow 36 attached to the blast wheel housing showing the rotating direction of the blast wheel assembly.

Figure 5:
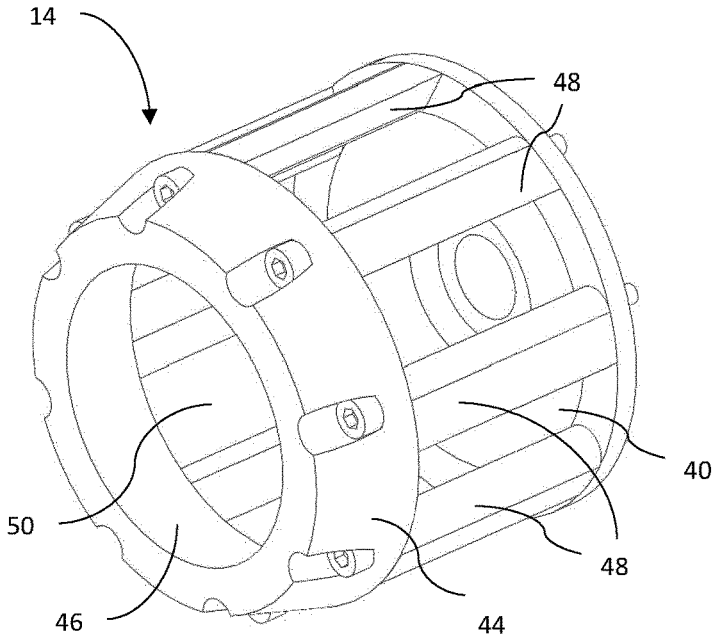
FIGS. 5 and 6 are perspective views of an impeller of an embodiment of the disclosure that is used in the centrifugal blast wheel machine.
Figure 6:
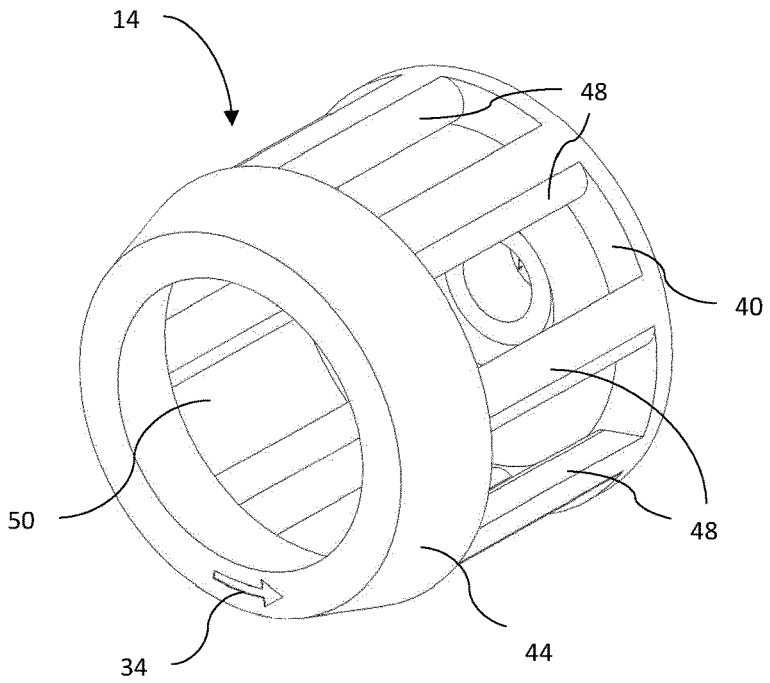

In one embodiment, the plurality of drop-shaped vanes 48 includes eight drop-shaped vanes, each having an angle 41 on the leading side 42 between 50° and 70°, preferably an angle of the leading side between 55° and 65° and a radius 43 of the trailing side 45 between 3 mm and 8 mm, preferably a radius of the trailing side between 4 mm and 7 mm. Since there are eight drop-shaped vanes 48, there are thus eight media openings 50 between adjacently placed vanes. In one embodiment, the drop-shaped vanes 48 are secured to their respective hub 40 and tapered section 44 by a bolt, e.g., M5x20 bolt (FIG. 5). As shown, the drop-shaped vanes 48 are spaced equidistant from each other around a periphery of the impeller 14. In one embodiment, the drop-shaped vanes 48 are spaced from each other in an equal circular pattern of eight or twelve, resulting in an angle of 45 degrees and 30 degrees, respectively. The drop-shaped vanes are spaced apart from one another with a center-to-center distance dictated by the number of vanes.

Figure 10:
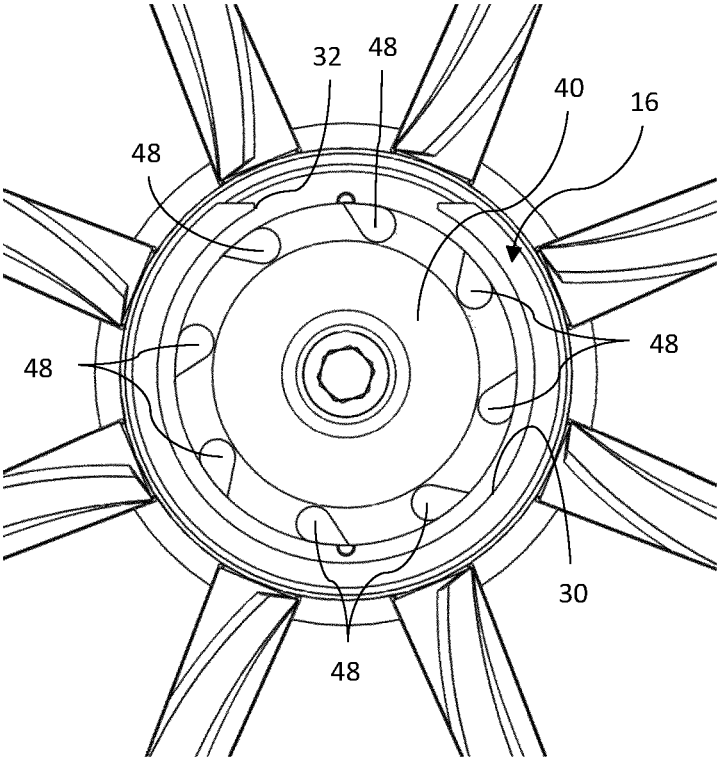
FIG. 10 is a front view of the impeller and a control cage of the centrifugal blast wheel machine.
Figure 11:
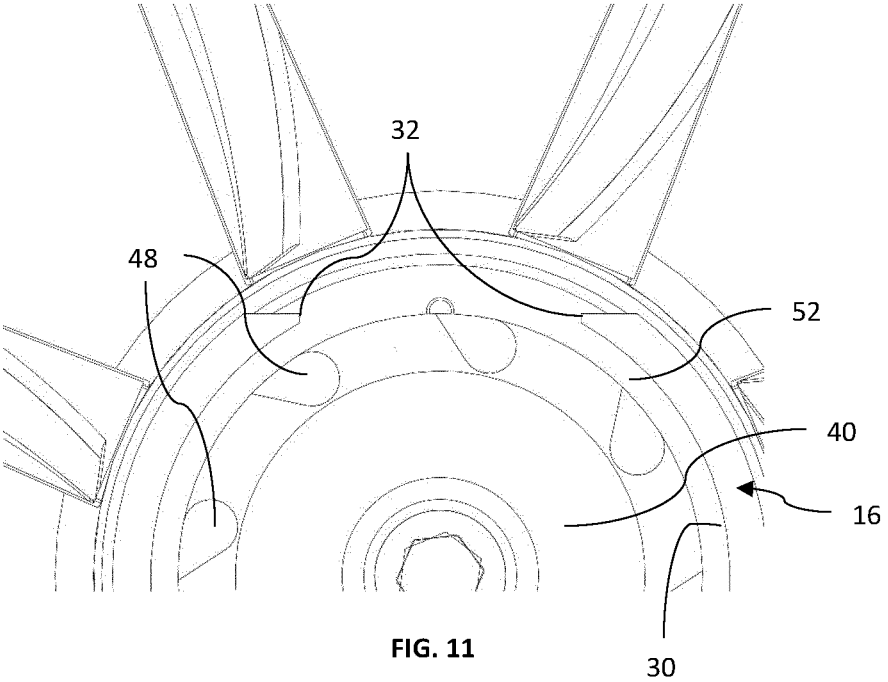
FIG. 11 is an enlarged portion of the impeller and the control cage shown in FIG. 10.

Referring additionally to FIGS. 10 and 11, the drop-shaped vanes 48 are spaced from the control cage 16 a predetermined distance as indicated by 52 (FIG. 11). In one embodiment, the predetermined distance of the spacing is at least 3 mm. As described above, the arrangement is such that blast media fed into the impeller 14 from the feed spout 22 contacts the drop-shaped vanes 48 of the rotating impeller and are accelerated to create a centrifugal force that moves the media particles in radial direction, away from the axis of the impeller. The blast media particles move through the media openings 50 formed in the impeller 14 into the space 52 between the impeller and the control cage 16. When the blast media particles that have passed through the media openings 50 of the impeller 14 into the space between the impeller 14 and the control cage 16 reach the opening 32 provided in the control cage, rotational and centrifugal forces move the particles through the opening and to the blades 26 of the blast wheel assembly 18.

In some embodiments, a method of operating a centrifugal blast wheel machine includes feeding blast media from a feed spout into an impeller of the centrifugal blast wheel machine, accelerating the blast media by rotating the impeller giving rise to a centrifugal force that moves the blast media in radial direction, away from an axis of the impeller, moving the blast media in a generally circular direction into a space between the impeller and a control cage, metering an amount of blast media through an opening of the control cage onto blades of a blast wheel, and moving the blast media along lengths of the blades to accelerate and throw the blast media toward a work piece. In one embodiment, the method is performed using the impeller 14 having the drop-shaped vanes shown and described herein.

The invention can be used on any known blast wheel in the industry that is used to throw abrasive. To begin the impeller shape and relation to the internal face of the control cage is critical in minimizing the impedance on abrasive flow, the distance between the two control surfaces is a range of between 4.75 mm and 5.75 mm typically. In addition, the flow is affected by the way in which the impeller face is in relation to control cage internal face as the abrasive movement transitions from linear to rotational motion against the control cage internal face. The drop-shaped form of the impeller drop-shaped vanes ensures gentle handling of the abrasive inside the impeller and its smooth transition from impeller inner space through the opening in the control cage to the blades and reduces the abrasive consumption.

Thus, it should be observed that an overall increase in efficiency of the throwing surface is in conjunction with the gentle handling of abrasive inside the impeller and more smooth transition of abrasive media from the impeller, which has been designed with optimal drop-shaped vanes to improve the release of media from impeller through the opening in the control cage to the throwing blade surface.

Embodiments of the impeller reduce the abrasive consumption, while keeping the other blast wheel parameters as abrasive throughput, blast pattern and blast intensity same or similar to conventional impeller vanes, using the same level of power as previously achieved which is achieved by changing the impeller configuration to drop-shaped vanes. The impeller is capable of providing better use of abrasive to perform the function of surface preparation or shot peening with a centrifugal wheel.

Embodiments of the impeller can be used on any of the impeller designs used within the industry, with varying shapes and sizes of control cage apertures. Moreover, the impeller vane enables superior media handling and smooth transition from impeller inner space through the opening in control cage to blades and the shape of the impeller promotes the reduction of abrasive consumption compare to conventional vanes.

Drop-shaped vanes of an impeller, each having an angle on the leading side between 50° and 70°, preferably an angle of the leading side between 55° and 65° and a radius of the trailing side between 3 mm and 8 mm, preferably a radius of the trailing side between 4 mm and 7 mm.

Drop-shaped vanes of the impeller reduce the abrasive consumption, while keeping the other blast wheel parameters as abrasive throughput, blast pattern and blast intensity same or similar to conventional impeller vanes, using the same level of power as previously achieved compare to the conventional impeller vanes.

Having thus described several aspects of at least one embodiment of this disclosure, it is to be appreciated various alterations, modifications, and improvements will readily occur to those skilled in the art. Such alterations, modifications, and improvements are intended to be part of this disclosure and are intended to be within the spirit and scope of the disclosure. Accordingly, the foregoing description and drawings are by way of example only.

What is claimed is:

1. A centrifugal blast wheel machine comprising:

a wheel assembly having a plurality of blades configured to throw blast media introduced into the wheel assembly against a work piece;

an impeller positioned about an axis of the wheel assembly, the impeller having a media inlet at one end adapted to receive blast media and a plurality of impeller media outlets constructed and arranged to allow egress of blast media upon rotation of the impeller;

a motor coupled to the impeller to drive the rotation of the impeller and the wheel assembly; and a control cage surrounding the impeller and secured to the wheel assembly, the control cage including a cylindrical body defining an interior chamber, the cylindrical body having an opening formed therein to allow the egress of blast media from the interior chamber, wherein the impeller includes a hub provided at one end of the impeller, the hub being configured to be coupled to the motor, a tapered section provided at an opposite end of the hub, the tapered section defining a media inlet to receive blast media, and a plurality of drop-shaped vanes positioned between the hub and the tapered section, the plurality of drop-shaped vanes being spaced from one another on peripheries of the hub and the tapered section, the plurality of drop-shaped vanes defining a plurality of impeller media outlets constructed and arranged to allow egress of blast media upon rotation of the impeller, and wherein each vane is drop-shaped having a leading side directed toward a direction of rotation of the impeller and a trailing side opposite the leading side, and wherein each drop-shaped vane has an angle of the leading side between 50° and 70° and a radius of the trailing side between 3 mm and 8 mm.

2. The centrifugal blast wheel machine of claim 1, wherein the plurality of drop-shaped vanes being spaced equidistant from one another on peripheries of the hub and the tapered section.

3. The centrifugal blast wheel machine of claim 2, wherein the plurality of drop-shaped vanes is spaced from the control cage a predetermined distance.

4. The centrifugal blast wheel machine of claim 3, wherein the predetermined distance is at least 3 mm.

5. The centrifugal blast wheel machine of claim 3, wherein the plurality of drop-shaped vanes includes eight drop-shaped vanes.

6. The centrifugal blast wheel machine of claim 1, wherein each vane of the plurality of drop-shaped vanes is spaced apart from one another with a center-to-center distance dictated by the number of vanes.

7. The centrifugal blast wheel machine of claim 1, wherein each drop-shaped vane has an angle of the leading side between 55° and 60° and a radius of the trailing side between 4 mm and 7 mm.

8. An impeller for a centrifugal blast wheel machine, the impeller comprising:

a hub provided at one end of the impeller, the hub being configured to be coupled to the motor;

a tapered section provided at an opposite end of the hub, the tapered section defining a media inlet to receive blast media; and a plurality of drop-shaped vanes positioned between the hub and the tapered section, the plurality of drop-shaped vanes being spaced from one another on peripheries of the hub and the tapered section, the plurality of drop-shaped vanes defining a plurality of impeller media outlets constructed and arranged to allow egress of blast media upon rotation of the impeller, wherein each vane is drop-shaped having a leading side directed toward a direction of rotation of the impeller and a trailing side opposite the leading side, and wherein each drop-shaped vane has an angle of the leading side between 50° and 70° and a radius of the trailing side between 3 mm and 8 mm.

9. The impeller of claim 8, wherein the plurality of drop-shaped vanes being spaced equidistant from one another on peripheries of the hub and the tapered section.

10. The impeller of claim 9, wherein the plurality of drop-shaped vanes is spaced from a control cage a predetermined distance.

11. The impeller of claim 10, wherein the predetermined distance is at least 3 mm.

12. The impeller of claim 10, wherein the plurality of drop-shaped vanes includes eight drop-shaped vanes.

13. The impeller of claim 8, wherein each vane of the plurality of drop-shaped vanes is spaced apart from one another with a center-to-center distance dictated by the number of vanes.

14. The impeller of claim 8, wherein each drop-shaped vane has an angle of the leading side between 55° and 60° and a radius of the trailing side between 4 mm and 7 mm.

15. A method of operating a centrifugal blast wheel machine, the method comprising:

feeding blast media from a feed spout into an impeller of the centrifugal blast wheel machine;

accelerating the blast media by rotating the impeller giving rise to a centrifugal force that moves the blast media in radial direction, away from an axis of the impeller;

moving the blast media in a generally circular direction into a space between the impeller and a control cage;

metering an amount of blast media through an opening of the control cage onto blades of a blast wheel; and moving the blast media along lengths of the blades to accelerate and throw the blast media toward a work piece, wherein the impeller includes a hub provided at one end of the impeller, the hub being configured to be coupled to the motor, a tapered section provided at an opposite end of the hub, the tapered section defining a media inlet to receive blast media, and a plurality of drop-shaped vanes positioned between the hub and the tapered section, the plurality of drop-shaped vanes being spaced from one another on peripheries of the hub and the tapered section, the plurality of drop-shaped vanes defining a plurality of impeller media outlets constructed and arranged to allow egress of blast media upon rotation of the impeller, and wherein each vane is drop-shaped having a leading side directed toward a direction of rotation of the impeller and a trailing side opposite the leading side, and wherein each drop-shaped vane has an angle of the leading side between 50° and 70° and a radius of the trailing side between 3 mm and 8 mm.

16. The method of claim 15, wherein the plurality of drop-shaped vanes being spaced equidistant from one another on peripheries of the hub and the tapered section.

17. The method of claim 16, wherein the plurality of drop-shaped vanes is spaced from the control cage a predetermined distance.

18. The method of claim 17, wherein the predetermined distance is at least 3 mm.

19. The method of claim 17, wherein the plurality of drop-shaped vanes includes eight drop-shaped vanes.

20. The method of claim 15, wherein each drop-shaped vane has an angle of the leading side between 55° and 60° and a radius of the trailing side between 4 mm and 7 mm.

* * * * *